US006858048B1

(12) United States Patent
Jimeson et al.

(10) Patent No.: US 6,858,048 B1
(45) Date of Patent: Feb. 22, 2005

(54) FUELS FOR INTERNAL COMBUSTION ENGINES

(75) Inventors: Robert M. Jimeson, Vienna, VA (US); Mark C. Radosevich, Durango, CO (US); Rex R. Stevens, Grand Junction, CO (US)

(73) Assignee: Standard Alcohol Company of America, Inc., Durango, CO (US)

( * ) Notice: Subject to any disclaimer, the term of this patent is extended or adjusted under 35 U.S.C. 154(b) by 173 days.

(21) Appl. No.: 10/124,665

(22) Filed: Apr. 17, 2002

Related U.S. Application Data

(60) Provisional application No. 60/284,619, filed on Apr. 18, 2001, provisional application No. 60/284,620, filed on Apr. 18, 2001, and provisional application No. 60/284,621, filed on Apr. 18, 2001.

(51) Int. Cl.[7] ..... C10L 1/18
(52) U.S. Cl. ..... 44/452
(58) Field of Search ..... 44/451, 452

(56) References Cited

U.S. PATENT DOCUMENTS

| | | | | | |
|---|---|---|---|---|---|
| 2,128,910 | A | * | 9/1938 | Bludworth | 44/309 |
| 3,822,119 | A | * | 7/1974 | Frech | 44/451 |
| 4,218,516 | A | | 8/1980 | Meyer et al. | |
| 4,298,354 | A | | 11/1981 | Hardman et al. | |
| 4,357,146 | A | * | 11/1982 | Heeren | 44/451 |
| 4,384,872 | A | * | 5/1983 | Kester et al. | 44/349 |
| 4,479,807 | A | | 10/1984 | Rebandt | |
| 4,533,508 | A | | 8/1985 | Stevens | |
| 4,561,861 | A | * | 12/1985 | Davis et al. | 44/302 |
| 4,675,344 | A | | 6/1987 | Conway et al. | |
| 4,705,532 | A | * | 11/1987 | Mazanec et al. | 44/452 |
| 4,752,622 | A | | 6/1988 | Stevens | |
| 4,752,623 | A | | 6/1988 | Stevens | |
| 4,762,858 | A | | 8/1988 | Hucul et al. | |
| 4,825,013 | A | | 4/1989 | Quarderer et al. | |
| 4,831,060 | A | | 5/1989 | Stevens et al. | |
| 4,871,397 | A | | 10/1989 | Stevens | |
| 4,882,360 | A | | 11/1989 | Stevens | |
| 4,895,662 | A | | 1/1990 | Stevens | |
| RE33,562 | E | | 4/1991 | Badger | |
| 5,288,393 | A | | 2/1994 | Jessup et al. | |
| 5,559,275 | A | | 9/1996 | Barger | |
| 5,653,866 | A | | 8/1997 | Jessup et al. | |
| 5,663,455 | A | | 9/1997 | Harris et al. | |
| 5,837,126 | A | | 11/1998 | Jessup et al. | |
| 6,030,521 | A | | 2/2000 | Jessup et al. | |
| 6,039,772 | A | * | 3/2000 | Orr | 44/359 |

FOREIGN PATENT DOCUMENTS

| | | | |
|---|---|---|---|
| CN | 1089299 | * | 7/1994 |

OTHER PUBLICATIONS

"The Economical Production of Alcohol Fuels from Coal–Derived Synthesis Gas", Quarterly Technical Progress Report No. 18, West Virginia University Research Corporation, Apr. 1996, 15 pages.

"Dow Develops Catalytic Method to Produce Higher Mixed Alcohols", Technology, Nov. 12, 1984, pp. 29–30.

"Mixed Alcohols from Synthesis Gas", Dow Chemical, M.J. Mintz and G.J. Quarderer, ppgs. 1–21.

"Evaluation of Synthesis Gas Based High Octane Oxygenates" (The Mixed Alcohols Option), Abdel Elsawy and David Gray, Nov. 1988, ppgs. 119–136.

Letter and enclosures from Lurgi GMBH to Wayne Kreis of The Texas Methanol Corporation, dated Jan. 19, 1987, ref: Octamix–Sample Shipment of Jan. 17, 1987, Frankfurt, Germany, 3 pages.

* cited by examiner

*Primary Examiner*—Cephia D. Toomer
(74) *Attorney, Agent, or Firm*—Geoffrey A. Mantooth

(57) ABSTRACT

Mixed alcohols can be used as a fuel additive in gasoline, diesel, jet fuel or as a neat fuel in and of itself. The mixed alcohols can contain $C_1$–$C_5$ alcohols, or in the alternative, $C_1$–$C_8$, or higher, alcohols in order to boost energy content. The $C_1$–$C_5$ mixed alcohols contain more ethanol than methanol with amounts of propanol, butanol and pentanol. $C_1$–$C_8$ mixed alcohols contain the same, with amounts of hexanol, heptanol and octanol. A gasoline-based fuel includes gasoline and the mixed alcohols. A diesel based fuel includes diesel and the mixed alcohols. A jet fuel includes kerosene and the mixed alcohols. The neat fuel of the mixed alcohols has an octane number of at least 109 and the Reid Vapor Pressure is no greater than 5 psi. The gross heat of combustion is at least 12,000 BTU's/lb.

10 Claims, No Drawings

FUELS FOR INTERNAL COMBUSTION ENGINES

This application claims benefit of U.S. Provisional 60/284,619, 60/284,620, and 60/284,621, all of which were filed Apr. 18, 2001.

FIELD OF THE INVENTION

The present invention relates to fuels used in internal combustion engines, and in particular to gasoline fuels, diesel fuels, jet fuels and alcohol fuels.

BACKGROUND OF THE INVENTION

Internal combustion engines are commonly used on mobile platforms (to propel vehicles), in remote areas (such as for oil well pumps or electric generators) or in lawn and garden tools (lawnmowers, etc.). There are various types of internal combustion engines. Spark type engines utilize a volatile fuel, such as gasoline. A spark plug provides the source of ignition. A typical fuel is gasoline, or in high performance engines, methanol. Compression type engines take in air and compress it to generate the heat necessary to ignite the fuel. Typical compression engines utilize diesel fuel.

When gasoline is burned, it produces pollutants in the form of hydrocarbons (HC), nitrogen oxides (NOx), carbon monoxide (CO) and soot (particulates). In addition, gasoline in warm climates tends to evaporate due to the presence of volatile organic compounds (VOCs).

Internal combustion diesel engines are commonly used in vehicles. When diesel is burned, it produces pollutants in the form of hydrocarbons (HC), nitrogen oxides (NOx), carbon monoxide (CO) and soot (particulates). Nitrogen oxides and volatile organic components react together in sunlight to form ground level ozone, a component of smog. Diesel has less of a tendency to evaporate than does gasoline.

In areas of high use, such as heavy automobile traffic, the emissions from the tail pipes of internal combustion engines and the evaporation from the fuel tanks result in significant air pollution. In some urban areas, a brown haze of pollution frequently hugs the first few hundred feet off of the ground.

Alcohol fuel additives have come into use for internal combustion engines in order to reduce harmful emissions. In the 1970's, gasohol, a blend of mostly gasoline with some ethanol, was introduced during the Arab oil crisis to extend supplies of gasoline. Unfortunately, at that time, many of the elastomeric engine components were designed only for gasoline or diesel and deteriorated with the use of ethanol. Since then, engines have become equipped with fluorinated elastomers, which are more tolerant to alcohol fuels.

Today, the primary alcohol fuel is ethanol, which is typically made synthetically or from grain (corn, wheat, barley, oats, etc.) in a fermentation process. The ethanol is blended into gasoline in various quantities. "Premium" gasoline, with a higher octane rating than "regular" gasoline, is primarily gasoline with 10% ethanol($C_2$ alcohol). Another ethanol fuel is E-85, which is 85% ethanol and 15% gasoline. Still another alcohol fuel is M-85, which is 85% methanol ($C_1$ alcohol) and 15% gasoline.

Grain ethanol is expensive to produce. Furthermore, producing sufficient quantities of grain ethanol to satisfy the needs of the transportation industry is not practical because food crops are diverted into fuel. Traditionally, grain ethanol has been heavily subsidized by government. Droughts and government policy towards farming in general (less intervention and payments to farmers) make the supply of grain ethanol uncertain and expensive.

In addition, both methanol and ethanol have a relatively low energy content when compared to gasoline. A motorist notices this when a vehicle running on gasoline achieves more miles per gallon than does a similar vehicle running on alcohol fuels.

Some time ago, in the United States, lead was added to gasoline to boost the octane rating. The octane rating relates to antiknock properties of gasoline. Lead has now been eliminated from gasoline for environmental reasons. For the past twenty years or so, gasoline sold in the United States has been blended with 5–15% methyl-tertiary-butyl-ether (MTBE), an oyxgenate, in order to raise the octane rating and to reduce environmentally harmful exhaust emissions. Unfortunately, MTBE is itself a pollutant, having an objectionable odor and taste and having been classified as a potential human carcinogen. To make matters worse, many gasoline storage tanks have developed leaks. MTBE is highly soluble in water and is low in biodegradability. MTBE features a trinary carbon bond which is difficult for natural organisms, such as bacteria, to break down. Consequently, MTBE has polluted the ground water in many communities. Several states, including California, are phasing out the use of MTBE. The phase out will result in an eventual ban.

The planned replacement for MTBE is grain ethanol, but as discussed above, producing the necessary quantities of grain ethanol to replace MTBE is problematic.

Therefore an effective replacement for MTBE in gasoline is needed. In addition, a diesel fuel having fewer harmful emissions, such as particulate soot, is needed. Furthermore, an alcohol fuel that is produced independently of farm products and with a higher energy content is needed.

SUMMARY OF THE INVENTION

It is an object of the present invention to provide a gasoline fuel blend stock that can be used as a substitute for MTBE.

It is another object of the present invention to provide a gasoline fuel that has reduced emissions of regulated pollutants.

It is another object of the present invention to provide a gasoline fuel blend stock that raises the octane number of the blended gasoline.

It is another object of the present invention to provide a gasoline fuel blend stock that reduces the need for lead in aviation gasoline.

It is another object of the present invention to provide a gasoline fuel blend stock that has a low Reid Vapor Pressure.

It is another object of the present invention to provide a gasoline fuel blend stock that has an energy content close to the energy content of gasoline alone.

It is an object of the present invention to provide a diesel fuel that produces less soot when combusted.

It is another object of the present invention to provide a diesel fuel that has fewer harmful emissions when combusted.

It is an object of the present invention to provide an alcohol fuel that reduces land and water pollution.

It is another object of the present invention to provide an alcohol fuel that has an energy content near that of gasoline.

The present invention provides a fuel for use in internal combustion engines, comprising gasoline and a mixture of alcohols. The mixture of alcohols comprises by volume 1–30% methanol, 40–75% ethanol, 10–20% propanol, 4–10% butanol and 1–8% pentanol.

The gasoline fuel need not contain MTBE. Instead, the mixed alcohols serve as an oxygenate to provide for reduced emissions. The mixed alcohols are water soluble and are biodegradable. Thus, the mixed alcohols are safer for land and water environments than MTBE.

In one aspect of the present invention, the mixed alcohols increases the octane of the gasoline to an octane number greater than 100. This eliminates or reduces the need to blend in benzene, a carcinogen, or other aromatics, to boost the octane. In some volumetric proportions, the blended octane number can be increased to 120 or greater. Thus, the gasoline fuel can be used as aviation gasoline without the need for harmful tetraethyl lead additives.

In another aspect of the present invention, the mixture of alcohols comprises 5–30% of the fuel by volume.

In another aspect of the present invention, the mixture of alcohols, by volume, further comprises 1–6% hexanol, 1–6% heptanol and 1–6% octanol.

The present invention also provides a composition of emission gases resulting from the combustion of a gasoline blend of fuel in an internal combustion engine, comprising total hydrocarbons between 0.032–0.57 grams per mile and carbon monoxide between 0.285–0.529 grams per mile.

In another aspect of the present invention, the composition of emission gases further comprises NOx gases between 0.058–0.063 grams per mile.

The present invention also provides a composition of emission gases resulting from the combustion of a gasoline blend of fuel in an internal combustion engine, comprising total hydrocarbons between 0.032–0.57 grams per mile and NOx gases between 0.058–0.063 grams per mile.

The present invention also provides a composition of emission gases resulting from the combustion of a gasoline blend of fuel in an internal combustion engine, comprising carbon monoxide between 0.285–0.529 grams per mile and NOx gases between 0.058–0.063 grams per mile.

The present invention also provides a composition of emission gases resulting from the combustion of a gasoline blend of fuel in an internal combustion engine, comprising nonmethane hydrocarbons between 0.030–0.048 grams per mile and carbon monoxide between 0.285–0.529 grams per mile.

The present invention also provides a composition of emission gases resulting from the combustion of a gasoline blend of fuel in an internal combustion engine, comprising nonmethane hydrocarbons between 0.030–0.048 grams per mile and NOx gases between 0.058–0.063 grams per mile.

In another aspect of the present invention, the composition of emission gases further comprises carbon monoxide between 0.285–0.529 grams per mile.

The present invention provides a fuel for use in diesel engines comprising diesel and mixed alcohols. The mixed alcohols comprise, by volume, 1–30% methanol, 40–75% ethanol, 10–20% propanol, 3–10% butanol and 1–8% pentanol.

The use of mixed alcohols in combination with diesel reduces the soot given off during combustion.

In accordance with another aspect of the present invention, the mixed alcohols comprises 5–20%, by volume, of the diesel fuel.

In accordance with another aspect of the present invention, the mixed alcohols further comprise, by volume, 1–6% hexanol, 1–6% heptanol and 1–6% octanol.

The present invention provides a mixed alcohol fuel for use in an internal combustion engine. The mixed alcohol fuel comprises, by volume, 1–30% methanol, 40–75% ethanol, 10–20% propanol, 3–10% butanol and 1–8% pentanol.

The mixed alcohol fuel can be used neat, that is without additions of gasoline or diesel in an internal combustion engine. The mixed alcohol fuel is water soluble and biodegradable. Consequently, it is non-polluting both to water and land environments. In addition, the mixed alcohol fuel can be made from a variety of waste materials including garbage and sewer sludge.

In accordance with one embodiment, the mixed alcohol fuel further comprises, by volume: 1–6% hexanol, 1–6% heptanol and 1–6% octanol.

The use of the higher alcohols, hexanol, heptanol, octanol, and so on increase the energy content of the mixed alcohol fuel such that the mixed alcohol fuel has an energy content nearer that of gasoline.

The present invention also provides a mixed alcohol fuel for use in an internal combustion engine comprising 20–30% methanol, 40–50% ethanol, 10–20% propanol, 3–8% butanol and 1–8% pentanol.

The present invention also provides a mixed alcohol fuel for use in an internal combustion engine that comprises the following properties: a blending octane number of at least 109 and a Reid Vapor Pressure no greater than 5 psi.

The present invention provides a jet fuel for use in a jet engine, comprising kerosene and a mixture of alcohols. The mixture of alcohols comprises by volume 1–30% methanol, 40–75% ethanol, 10–20% propanol, 4–10% butanol and 1–8% pentanol.

In another aspect of the present invention, the mixture of alcohols by volume, further comprises 1–6% hexanol, 1–6% heptanol and 1–6% octanol.

In accordance with one aspect of the present invention, the mixed alcohol fuel has a gross heat of combustion of at least 12,000 BTU's per pound.

DESCRIPTION OF THE PREFERRED EMBODIMENTS

The present invention provides mixed alcohols that can be used as an additive to gasoline-based fuels, diesel-based fuels or jet fuels in internal combustion engines. In addition, the mixed alcohols can be used as "neat", that is without blending into gasoline, diesel or jet fuel.

When used as an additive to gasoline-based fuels, the mixed alcohols can be used as a substitute for MTBE and/or for grain ethanol. The gasoline-based fuel is gasoline and mixed alcohols. The mixed alcohols are an oxygenate. The fuel, when combusted in an internal combustion engine, reduces hydrocarbon and carbon monoxide emissions, while having an increased octane number and a decreased Reid Vapor Pressure. In addition, deposits on the intake valves and the combustion chambers of the engine are reduced.

When used as an additive to diesel-based fuels, the mixed alcohols are an oxygenate. The present invention provides a diesel-based fuel that can be used in internal combustion engines. The diesel-based fuel is diesel and mixed alcohols. The fuel, when combusted in an internal combustion engine, reduces emissions.

When the mixed alcohols are used "neat", without gasoline or diesel, the spark-type internal combustion engine has reduced tailpipe emissions.

The mixed alcohols fuels can be used in a variety of internal combustion engines in automobiles, aircraft and a variety of tools such as lawnmowers and hand-held tools with internal combustion engines. Currently the ethanol based fuel E-85 is used in flexible fuel vehicles (FFV). The mixed alcohol fuels can be used in such FFV vehicles. Slight tuning or adjustment of the engine may provide extra power and lower emission values.

The mixed alcohols contain alcohols having different numbers of carbon atoms. There are various types of alcohols, which are classified according to the number of carbon atoms. For example, methanol ($C_1$) has one carbon atom, ethanol ($C_2$) has two carbon atoms, propanol ($C_3$) has three carbon atoms and so on. The alcohols are, preferably normal and are designated n-propanol, n-butanol, etc. Although the present invention discusses normal alcohols, iso-alcohols could be used as well.

The mixed alcohols of the present invention comprise a number of alcohols. Typically, methanol and ethanol together comprise over 50%, by volume, of the mixed alcohols, with other alcohols and small amounts of non-alcohol components making up the remainder. A typical mixture of mixed alcohols is, by volume:

1–30% methanol

40–75% ethanol

10–20% propanol

4–10% butanol

1–8% pentanol

1–6% hexanol

1–6% heptanol

1–6% octanol

1–3% nanonol

1–3% decanol.

Typically, the amount of ethanol exceeds the amount of methanol. In fact, the mixed alcohols may contain the highest proportion of ethanol, with the other alcohols comprising smaller proportions. Ethanol has more energy density than does methanol. Typically, the energy density increases with the increasing carbon content in the higher alcohols. The higher alcohols $C_6$–$C_8$ (hexanol, heptanol and octanol) have more energy density than do the lower alcohols $C_1$–$C_5$.

Traditionally, the use of ethanol as an additive has resulted in fuel that has a lower energy density (measured in Btu/lb) than does fuel without ethanol. Thus, the miles per gallon that can be achieved by a typical internal combustion engine powered vehicle is slightly lower when using an ethanol and fuel (such as gasoline) blend than when using fuel without ethanol. However, with the present invention, the use of higher alcohols $C_6$–$C_8$ increases the energy density of the alcohol mixture. Thus, little or no energy loss is incurred when using the mixed alcohols as a fuel additive. In fact, the mixed alcohols can contain higher alcohols such as $C_9$, $C_{10}$, etc.

The use of $C_6$–$C_8$ alcohols, while preferred, is optional. Thus, the mixed alcohols blended in gasoline can contain $C_1$–$C_5$ alcohols only. Upon combustion, mixed $C_1$–$C_5$ alcohols in combination with gasoline produces lower emissions of hydrocarbons and carbon monoxide relative to gasoline-only type fuels. A typical mixture of mixed alcohols ($C_1$–$C_5$) is, by volume:

1–30% methanol

40–75% ethanol

10–20% propanol

4–10% butanol

1–8% pentanol.

The mixed alcohols ($C_1$–$C_5$ or $C_1$–$C_8$) can be blended manually by providing the various components in the proper proportions. Alternatively, the mixed alcohols can be made in large commercial quantities by other means. For example, the mixed alcohols can be made by pass ing synthesis gas (containing about 1 to 1 molar ratio of CO to $H_2$) over a potassium-promoted $CoSMoS_2$ catalyst at about 1500 psig and 300 degrees C. This process is more fully described in U.S. Pat. Nos. 4,752,622 and 4,882,360.

The mixed alcohols can contain some impurities due to the manufacturing process. Such impurities include esters, water and trace amounts of hydrocarbons. These impurities can be removed if required by the particular application. For example, water can be removed by drying the alcohol mixture using one or more commercially available techniques (such as glycol extraction, distillation or molecular (zeolite) sieves.

Note that the mixed alcohols are water soluble and function as water getters. Methanol has long been added to gasoline tanks to get the water. When there in too much water however, the methanol and water separate from the fuel. This can cause engine problems. An engine can tolerate some water in the fuel, so long as it is well mixed. The use of the higher alcohols ($C_3$–$C_8$) serve to mitigate separation of the contaminant water in the fuel.

The mixed alcohols can be blended into gasoline, jet or diesel fuels. Generally speaking, gasoline, jet and diesel fuels are primarily derived from crude oil and contain additives. Gasoline, jet fuel and diesel are all well known fuels. Jet fuel contains kerosene.

The mixed alcohols can be blended with gasoline so as to make a blended fuel. The blended fuel can contain 1–99% by weight of mixed alcohols with the remainder being gasoline. Such a blended fuel has an enhanced octane. The mixed alcohols is a more effective octane enhancer than is either MTBE or ethanol for gasoline. The mixed alcohols are biodegradable in land and water environments. This is unlike MTBE, which persists and pollutes land and water environments. Mixed alcohols can be used as a direct replacement or substitute for MTBE in gasoline. Thus, when mixed alcohols are used in gasoline, MTBE need not be added to that gasoline.

In addition, the mixed alcohols can substitute for E-85 fuel blends (which are 85% grain ethanol and 15% gasoline). E-85 fuel blends are used in flex equipped factory internal combustion engines, called Flex Fueled Vehicles (FFVs).

The gasoline is preferably unleaded gasoline, which is conventional and commercially available. Gasoline is a well-known fuel comprising mixtures of aromatics, olefins and paraffins. Gasoline may be known in other countries by other terms, such as petrol or benzene. The boiling points of these hydrocarbons is typically 77–437 degrees F. Gasoline may also include additives, such as detergents, anti-icing agents, demulsifiers, corrosion inhibitors, dyes, deposit modifiers and octane enhancers (such as tetraethyl lead). As discussed above, global gasoline supplies are preferably unleaded (that is, containing little or no tetraethyl lead).

There are several different blends of unleaded gasoline currently sold in the United States. These are conventional gasoline, winter oxygenated gasoline and reformulated gasoline. Conventional gasoline is formulated with a lower Reid Vapor Pressure (RVP) in order to evaporate more slowly in hot weather thereby reducing smog. Winter oxygenated and reformulated gasolines contain MTBE and may contain ethanol to produce a cleaner burning fuel.

The mixed alcohols can be used as a substitute for MTBE and/or ethanol in gasoline, such as reformulated gasoline and/or winter oxygenated gasoline.

In addition, conventional commercial gasoline has an octane number between 87 and 92. So called regular gasoline has an octane number (R/2+M/2) of about 87, while premium gasoline has an octane number of about 92. The octane number is a measure of the resistance of the gasoline to premature detonation in the engine. Premature detonation wastes the energy in the fuel and can harm the engine. An engine that knocks or pings during operation is experiencing premature detonation. Using a gasoline with a higher octane number typically lessens or eliminates the knocking or pinging problem.

The mixed alcohols enhance the octane number of the fuel. This is particularly advantageous for aviation fuel. Aviation fuel is typically gasoline having a higher octane number (120 or greater) than automotive gasoline. Tetraethyl lead is added to gasoline in order to produce the higher octane number required for aviation gasoline. Tetraethyl lead used to be added to automotive gasoline in order to raise the octane number. However, the use of lead in gasoline has been all but eliminated in the United States, Canada and several developed countries, with the exception of aviation gasoline. Thus, the use of mixed alcohols can enhance the octane number of gasoline in order to produce aviation gasoline, without the use of harmful, poisonous lead.

In a preferred embodiment having a somewhat lower Btu range, tests were conducted on the following mixture of mixed alcohols, by volume:

28.6% methanol 47.0% ethanol 14.4% n-propanol 3.7% n-butanol 2.5% n-pentanol 3.8% esters. (I)

The esters were methyl acetate (1.9%) and ethyl acetate (1.9%). The oxygen mass concentration for the above mixed alcohols is 34%.

When mixed alcohols containing $C_1$–$C_5$ alcohols were blended with unleaded gasoline, which gasoline contained no other oxygenate, the blending octane number of the mixed alcohols was measured as 109. It is believed that the octane number can exceed 135 under different blending conditions and volumetric concentrations. Test methods ASTM D 2699 and 2700 were used to determine octane number.

The Reid Vapor Pressure (RVP) of the mixed alcohols is low. RVP is a measure of a fuel's propensity to vaporize or evaporate. The higher the RVP, the more vaporization. A low RVP is preferred to prevent vapor lock and reduce evaporative emissions (such as summertime evaporation of fuel from fuel tanks). A higher RVP is preferred in cold seasons to improve cold starts of engines. Reformulated gasoline has an RVP of between 6.4–10.0 psi. The measured RVP of the mixed alcohols $C_1$–$C_5$ is 4.6 psi (using test method ATSM D 5191). The blending RVP's of MTBE and pure ethanol are 8–10 psi and 17–22 psi, respectively. Measured RVP's may differ from blending RVP's. Reformulated gasoline currently requires 2% by weight of oxygen in the fuel. It is believed that the blending of the mixed alcohols into gasoline will not significantly raise the RVP of the blended gasoline. Thus, the mixed alcohols can raise the oxygen content of the fuel without raising the RVP.

The volumetric energy content of the mixed alcohols ($C_1$–$C_5$) is lower than gasoline, oxygenated gasoline (with MTBE). However, the energy content of the mixed alcohols is equal to or greater than E-85. It is believed that by incorporating $C_6$–$C_8$ alcohols into the mixed alcohols, the energy density will be similar to gasoline. Thus, the use of mixed alcohols $C_1$–$C_8$ with gasoline will produce the desired oxygen content (and resulting emissions reduction) while avoiding an energy penalty. A vehicle using a blend of mixed alcohols $C_1$–$C_8$ and gasoline will have about the same miles per gallon as with gasoline alone.

The use of mixed alcohols $C_1$–$C_5$ and gasoline reduces intake valve deposits (IVD) and combustion chamber deposits (CCD). As the concentration of mixed alcohols $C_1$–$C_5$ increases relative to gasoline, the deposits decrease. Furthermore, there is no problem with sludge or varnish in the engine when using mixed alcohols. Engine lubricants may need to be changed to a lubricant that is better adapted to acidic combustion products.

Emission characteristics will now be described. Emission characteristics were obtained by combusting two fuels separately in a 3.8L Buick LeSabre. The fuels were gasoline alone and a blend of 15% mixed alcohols (see (I) above) and 85% gasoline. The tests were performed in accordance with the Federal Test Procedure (FTP). The FTP refers to Code of Federal Regulations, Volume 40, "Protection of the Environment", herein incorporated by reference in its entirety. The engine was tuned to combust the gasoline alone. No adjustments were made to combust the blended fuel of mixed alcohols and gasoline.

A Clayton Model ECE-50 passenger dynamometer with a direct drive variable inertia flywheel system was used for testing. The inertia weight simulates equivalent weights of vehicles from 1000 pounds to 4875 pounds in 125 pound increments. The inertia weight and horsepower settings for the dynamometer were 3750 lb and 7.2 hp, respectively.

A positive displacement-type constant volume sampling system (CVS) was used to dilute the vehicle exhaust before collecting emission samples. A 10 inch diameter by 12 foot long stainless steel dilution tunnel was used with the CVS.

The vehicle hood was maintained fully open during all cycles, and was closed during the soak (turned off) periods. A cooling fan of 5,000 cfm was used in front of the test vehicle to provide air flow during all of the tests. During soaks, the fan was turned off.

For emission testing, the vehicles were operated over the Urban Dynamometer Driving Schedule (UDDS). The UDDS is the result of more than ten years of testing by various groups to translate the Los Angeles smog-producing driving conditions to dynamometer operations, and is a non-repetitive driving cycle covering 7.5 miles in 1372 seconds with an average speed of 19.7 mph. The maximum speed is 56.7 mph. An FTP consists of a cold start, 505 seconds, cold transient phase, followed immediately by an 867 seconds, stabilized phase. Following the stabilized phase, the vehicle was allowed to soak for ten minutes with the engine turned off before proceeding with a hot start, 505 seconds, hot transient phase to complete the test.

The emissions are mathematically weighted to represent the average of several 7.5 mile trips made from hot and cold starts. Exhaust emissions for the FTP cover the effects of vehicle and emission control system warmups as the vehicle is operated over the cycle. The stabilized phase produces emissions from a fully warmed up or stabilized vehicle and an emission control system, "Hot start" or "hot transient" phase emissions result when the vehicle and emission control systems have stabilized during operations, and are then soaked (turned off) for ten minutes.

Several of the regulated emissions (HC, CO) were reduced when the engine used the blend of mixed alcohols and gasoline. For gasoline alone, the total hydrocarbon emissions (THC) were 0.058–0.059 grams (g) per mile, while for the blend of mixed alcohols and gasoline, THC emissions were 0.032–0.070 grams per mile. Some of the THC emissions comprised methane. The non-methane hydrocarbon (NMHC) emissions were 0.049–0.054 grams per mile for gasoline alone and 0.030–0.067 grams per mile for the blend of mixed alcohols and gasoline. The CO emissions were 0.573–0.703 grams per mile for gasoline alone and 0.285–0.529 grams per mile for the blend of mixed alcohols and gasoline. The NOx emissions were 0.052–0.058 grams per mile for gasoline and 0.059–0.063 grams per mile for the blend of mixed alcohols and gasoline. Thus, the use of mixed alcohol significantly decreased carbon monoxide emissions, decreased hydrocarbon emissions and slightly increased NOx emissions.

The use of mixed alcohols and gasoline slightly increased emissions of formaldehyde and acetaldehyde relative to gasoline alone. The formaldehyde emissions were 0.781–0.859 milligrams (mg) per mile for gasoline alone and 0.900–1.415 mg per mile for mixed alcohols and gasoline. The acetaldehyde emissions were 0.126–0.294 mg per mile for gasoline alone and 0.244–0.427 mg per mile for mixed alcohols and gasoline. It is believed that the presence of esters in the mixed alcohols contributed to the increase in formaldehyde and acetaldehyde. The esters can be removed from the mixed alcohols to reduce these emissions.

The mixed alcohols can be blended with jet fuel so as to make a blended fuel. Jet fuel is primarily kerosene with additives. The blended fuel can contain 1–30% by volume of the mixed alcohols, with the remainder being jet fuel.

The mixed alcohols can be blended with diesel so as to make a blended fuel. The blended fuel can contain 1–30% by volume of mixed alcohols with the remainder being diesel. Diesel is a well-known fuel.

A mixed alcohols-diesel fuel blend containing 10% mixed alcohols (see (I) above) and 90% diesel fuel was made up and tested. The results were as follows:

| Test Parameter | Test Method | Result |
|---|---|---|
| Specific Gravity | ASTM D 4052 | 0.7514 |
| Carbon/Hydrogen (wt %) | ASTM D 5291 | 80.86/12.92 |
| Cetane Number | ASTM D 613 | 43.4 |
| Sulfur Content | ASTM D 2622 | 354 PPM |
| Oxygen Content | ASTM D 5599 | 1.16 wt % |
| Heat of Combustion | ASTM D 240 | Btu/lb |
| Gross | | 19079.9 |
| Net | | 17933.1 |
| HFRR | ASTM D6079 | 205 microns |
| Boiling Distribution | ASTM D86 | ° F. |
| IBP | | 147.2 |
| 5% | | 175.3 |
| 10% | | 340.0 |
| 15% | | 404.1 |
| 20% | | 423.5 |
| 30% | | 445.7 |
| 40% | | 469.9 |
| 50% | | 490.9 |
| 60% | | 512.2 |
| 70% | | 534.7 |
| 80% | | 559.1 |
| 90% | | 590.9 |
| 95% | | 615.6 |
| FBP | | 631.9 |
| Recovered % | | 98.3 |
| Loss % | | 0.5 |
| Residue % | | 1.2 |

The use of mixed alcohols in diesel will reduce the particulates produced during combustion. In addition, it is believed that regulated emissions (hydrocarbons, carbon monoxide and nitrogen oxides) will be reduced.

In order to better blend the water soluble mixed alcohols with diesel, a surfactant can be used. One such commercially available surfactant that is expected to work well is Octimax 4900 available from Octel Starion.

The mixed alcohols can be volumetrically blended with diesel as follows: 50% mixed alcohols, 50% diesel. A diesel engine operating on such a fuel blend would likely need a one-time adjustment of its fuel injectors to achieve the proper air-fuel mixture. Fleet vehicle applications could benefit in particular from such a fuel blend.

The blending of the mixed alcohols into gasoline or diesel can occur in a variety of manners. The mixed alcohols can be added to tanker trucks or rail cars. The movement of the tankers during transport will blend or mix the mixed alcohols into the gasoline or diesel. Another way of blending is to add the mixed alcohols to the fuel tank of a vehicle which is to combust the fuel. Again, the movement of the tank as the vehicle moves is sufficient to mix the fuel with the mixed alcohols. Still another way is to meter the mixed alcohols into a tank with the fuel.

The mixed alcohols can be used as a neat fuel in internal combustion engines. That is to say, the mixed alcohols need not be blended with gasoline or diesel. The engine may need to be tuned to operate on a mixture of alcohols alone. The octane number of the neat fuel mixed alcohols is between 109 and 138. The high octane number is particularly advantageous for aviation gasolines, which require an octane number from 100 to 120 or greater. In fact, an experimental aircraft made a transatlantic flight using ethanol alone. It is believed that the use of the mixed alcohols of the present invention, with its higher energy density, will become a superior aircraft fuel over ethanol because of the increased octane, energy density (BTUs per pound) and water-binding characteristics.

Several tests were conducted on the neat fuel mixed alcohols (see (I) above) to determine octane number. It was determined that the neat mixed alcohols would not ping in research engines designed to measure ping or preignition. The octane of the neat mixed alcohols exceeded the upper threshold of these research engines.

In order to attempt to estimate the octane of the mixed alcohols, a test was conducted with the mixed alcohols blended at 5% volume with 85 octane reference gasoline. The research octane was measured at 118.9 using test method ASTM D 2699 and the motor octane was measured at 98.2 using test method ASTM D 2700. The calculated octane number (R+M)/2 was 108.6. Thus, 108.6 is a blending octane rating.

To further delineate an octane rating of the neat mixed alcohols of (1), a 50/50 mixture of isooctane and heptane was used as a reagent source with a known reference octane of 50. Then, the mixed alcohols were blended at 50% volume with isooctane/heptane. The research engines needed to be rejetted before a ping could be detected, in order to accommodate the measuring of an octane greater than 110. After rejetting, research octane was measured at 148.8, motor octane was measured at 126.8 and the calculated octane number was 137.8, using the test methods described above.

Experiments demonstrated that neat mixed alcohols should provide a stand alone octane above 130. The blending characteristics of the mixed alcohols are not linear. Therefore, the blending octane numbers provided by the mixed alcohols will depend solely upon what fuel products they are blended into and at what volume percentages.

Reid Vapor Pressure was measured at 4.6 psi using test method ASTM D 5191. This low, mid-range Reid Vapor Pressure is particularly desired in warm climates where volatile organic compounds (VOC's) from evaporation of fuels is a source of pollution. The Reid Vapor Pressure can be between 4.0–5.0 psi.

The heat of combustion of the neat fuel mixed alcohols was measured using test method ASTM D 240. The gross heat of combustion was 12,235 BTU/lb. and the net was 11,061 BTU/lb. It is believed that this is slightly below the heat of combustion of gasoline. The use of $C_6$–$C_8$ alcohols in the neat fuel mixed alcohols are expected to increase the heat of combustion to approach that of gasoline.

The drivability index was measured at 949 using test method ASTM D 86. It is preferred if the drivability index does not exceed 1250. Thus, the neat fuel mixed alcohols drivability index was well below the maximum amount.

A corrosion test was performed on the neat fuel mixed alcohols to determine compatibility with types of metals that might be used in an internal combustion engine. The corrosion test was conducted using test method ASTM D 4636. Iron, copper, aluminum, magnesium and cadmium showed zero milligrams of loss. This indicates that the neat fuel mixed alcohol is as good as gasoline in being compatible with engine components.

Another engine component are elastomers, which are used in seals, etc. Internal combustion engines are typically provided with fluorinated elastomers, which are better suited to alcohol type fuels than non-fluorinated elastomers. The test method for fluorinated elastomer compatibility was ASTM D 471. After 240 hours, run at 50 degrees C., the volume change (percentage) was +25.81–26.01; hardness change (in points) was −22–−23; the tensile strength change (percentage) was −41.40–−45.93; and the elongation change (percentage) was −0.5763–−0.6937. The elongation change test had one data point reading 6.3490%. It is believed that this particular data point is an aberration.

Still another formulation of the mixed alcohols is, by weight:

10–30% methanol
40–60% ethanol
10–20% propanol
3–8% butanol
1–5% pentanol
3% max hexanol
0.3% max heptanol
0.1% max octanol.

A particular embodiment of the mixed alcohols is, by weight:

17.1% methanol
49.0% ethanol
17.3% propanol
7.0% butanol
5.1% pentanol
3.2% hexanol
0.3% heptanol
0.1% octanol.

The above mixed alcohols can be used in gasoline, in diesel or neat as a substitute fuel.

The foregoing disclosure and showings made in the drawings are merely illustrative of the principles of this invention and are not to be interpreted in a limiting sense.

What is claimed is:

1. A fuel for use in internal combustion engines, comprising:

a) gasoline;

b) a mixture of alcohols comprising by volume:
1–30% methanol
40–75% ethanol
10–20% propanol
4–10% butanol
1–8% pentanol
1–6% hexanol
1–6% heptanol
1–6% octanol.

2. A fuel for use in diesel engines, comprising:

a) diesel;

b) mixed alcohols comprising by volume:
1–30% methanol
40–75% ethanol
10–20% propanol
3–10% butanol
1–8% pentanol.

3. The fuel of claim 2 wherein the mixed alcohols comprise 5–20% of the fuel by volume.

4. The fuel of claim 2 wherein the mixed alcohols comprise, by volume:

1–6% hexanol
1–6% heptanol
1–6% octanol.

5. A mixed alcohol fuel for use in an internal comprising, by volume:

1–30% methanol
40–75% ethanol
10–20% propanol
3–10% butanol
1–8% pentanol
1–6% hexanol
1–6% heptanol
1–6% octanol.

6. A jet fuel for use in a jet engine, comprising:

a) kerosene;

b) a mixture of alcohols comprising by volume:
1–30% methanol
40–75% ethanol
10–20% propanol
4–10% butanol
1–8% pentanol.

7. The jet fuel of claim 6 wherein the mixture of alcohols by volume, further comprises:

1–6% hexanol
1–6% heptanol
1–6% octanol.

8. The fuel of claim 2 further comprising:

1–3% nananol
1–3% decanol.

9. The fuel of claim 5 further comprising:

1–3% nananol
1–3% decanol.

10. The fuel of claim 6 further comprising:

1–3% nananol
1–3% decanol.

* * * * *